US005345147A

United States Patent [19]

Wu

[11] Patent Number: 5,345,147

[45] Date of Patent: Sep. 6, 1994

[54] STAGED SELECTION TYPE CHRISTMAS LIGHT CONTROLLER CIRCUIT

[76] Inventor: Wei-Kuo Wu, No. 6, Industrial E. 2nd Rd., Science-based Industrial Park, Hsin-chu, Taiwan

[21] Appl. No.: 18,566

[22] Filed: Feb. 17, 1993

[51] Int. Cl.[5] ..... H05B 37/00

[52] U.S. Cl. ..... 315/185 S; 315/323; 315/360

[58] Field of Search ..... 315/185 S, 323, 360, 315/362

[56] References Cited

U.S. PATENT DOCUMENTS

| | | | |
|---|---|---|---|
| 3,793,531 | 2/1974 | Ferrigno | 315/185 S |
| 4,215,277 | 7/1980 | Weiner et al. | 315/323 |
| 4,432,224 | 2/1984 | Typpo | 315/185 S |
| 4,890,000 | 12/1989 | Chou | 315/185 S |
| 5,006,724 | 4/1991 | Liu | 315/185 S |
| 5,229,690 | 7/1993 | Ohnishi et al. | 315/362 |
| 5,256,948 | 10/1993 | Boldin et al. | 315/185 S |

*Primary Examiner*—Edward K. Look
*Assistant Examiner*—Mark Sgantzos
*Attorney, Agent, or Firm*—Morton J. Rosenberg; David I. Klein

[57] ABSTRACT

A staged selection type Christmas light controller circuit is provided. The light controller includes a rectifier, a current-limiter, a voltage regulator, a separator, a power stage generator, a selector switch, an oscillator, an integrated circuit controller, a driver, and a plurality of Christmas lights. The rectifier, the current-limiter, and the voltage regulator are connected in series with a power plug for providing DC voltage to the power input pin of the integrated circuit controller. A separator circuit is connected with the output end of the rectifier or the current-limiter and is coupled to the selection trigger pin of the integrated circuit controller through the power stage generator and the selector switch. An oscillator is coupled to the integrated circuit controller and the Christmas light sets are coupled to the controller through a driver. The power stage generator produce a signal for triggering the sequencing of the controller circuit responsive to cycling of the power on and off within a predetermined time period.

4 Claims, 3 Drawing Sheets

STAGED SELECTION TYPE CHRISTMAS LIGHT CONTROLLER CIRCUIT

BACKGROUND OF THE INVENTION

1. Field of the Invention

The invention relates to a new staged selection type Christmas light controller circuit that comprises a rectifier, a current-limiter, and a voltage regulator; which are commonly found in a conventional Christmas light controller circuit, these components being connected in series and attached to an integrated circuit controller. A branch having a separator and a power stage generator and connected to the stage selection trigger pin of the integrated circuit is arranged between the rectifier and the current-limiter. As the power is turned on or off, a positive or negative voltage drop occurs between the connection of the integrated circuit controller with the voltage regulator and the power stage generator and so it triggers the negative or positive voltage trigger preset in the integrated circuit.

2. Prior Art

A prior art Christmas light controller and its circuit commonly has a power plug on one end and controlled light sets on the other end, or the power plug and the controlled light sets are arranged on the same side of the controller.

The control circuit of a prior art Christmas light controller consists of a rectifier, a current-limiter, a voltage regulator, an oscillator, a selector switch, a driver, and an integrated circuit; in which the integrated circuit controls its own internal codes in accordance with the action of the selector switch to govern a driver producing the light variation of an outside light set. The integrated circuit is composed of an oscillatory circuit, an internal code varying circuit, a stage selection circuit, and an output control circuit. The stage selector switches are divided into three types; multiple stage stepped switches, multiple stage continuous switches, and push button switches. A shortcoming existing in the prior art Christmas light set is the short distance that must be maintained between the controllers and the light set. An extension line is needed when the light set is used outside the door, which makes the controller far away from people so that people cannot often change power stages at their will. Although a radio remote controller can be used, the scope restriction in angles and distances and high prices have made it unpopular.

OBJECT OF THE INVENTION

The principal object of the invention is to provide a new staged selection type Christmas light controller circuit that makes use of the turning off or turning on of a power source to trigger the stage selection of a Christmas light set accomplishing the effect of variation of the lights.

The other object of the invention is to provide a controller circuit that enables a Christmas light bulb string to be extended limitlessly toward outdoors or indoors, not being restricted by the requirement that a prior art controller be located in the vicinity of the light set.

BRIEF DESCRIPTION OF THE DRAWINGS

The above objects and other features of the invention will become apparent by reference to the following description taken in conjunction with the accompanying drawings in which.

DETAILED DESCRIPTION OF THE PREFERRED EMBODIMENTS

Figure 1:
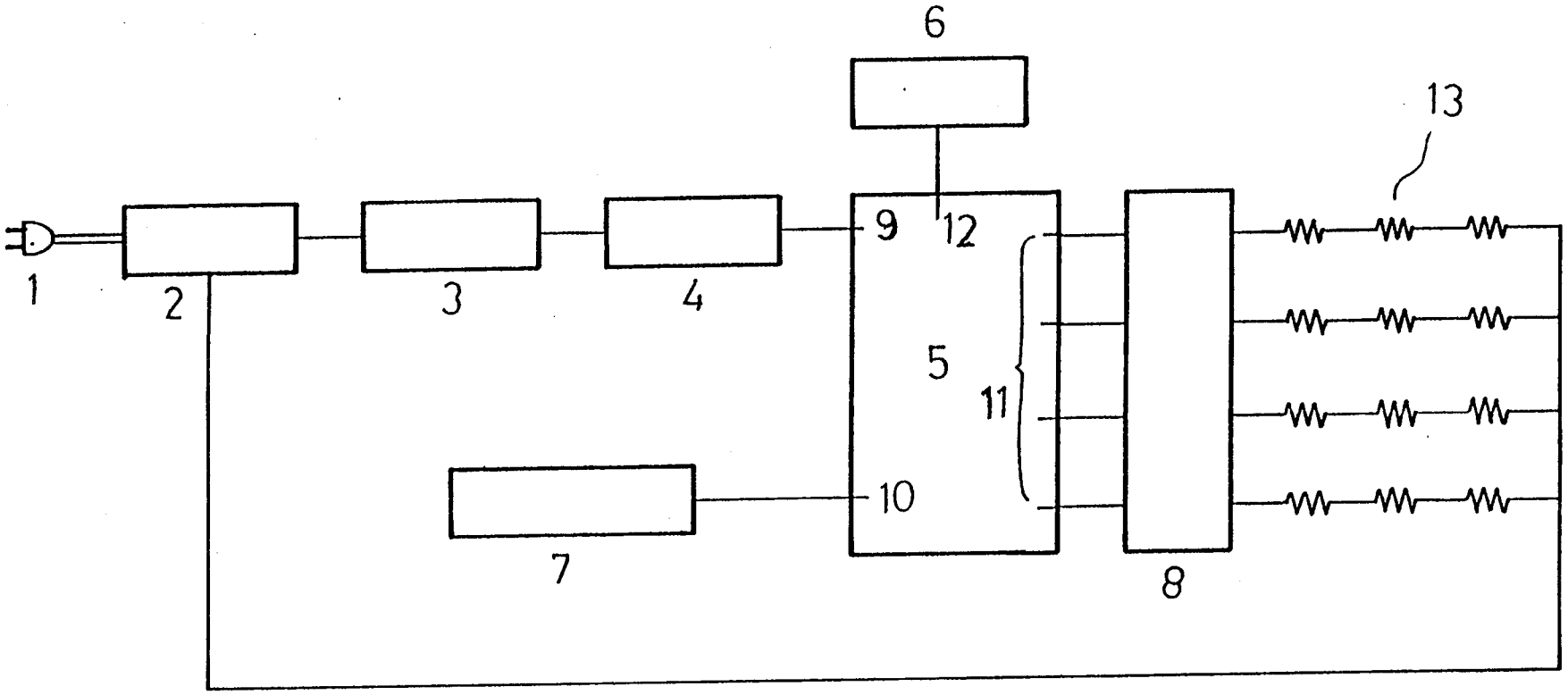
FIG. 1 (prior art)
FIG. 1 is a block diagram of a Christmas light controller circuit of the prior art.

Referring to FIG. 1, a prior art Christmas light controller circuit consists of a rectifier 2, a current-limiter 3, and a voltage regulator 4 attached to a power plug 1 in sequence and connected to the power input pin 9 of an integrated circuit controller 5 which is further connected to an oscillator 6 and a selector switch 7 at its oscillator pin 12 and selection trigger pin 10 respectively. A driver 8 is connected to the output pin 11 of integrated circuit 5. In addition, a Christmas light set 13 is coupled to the driver 8.

Figure 2:
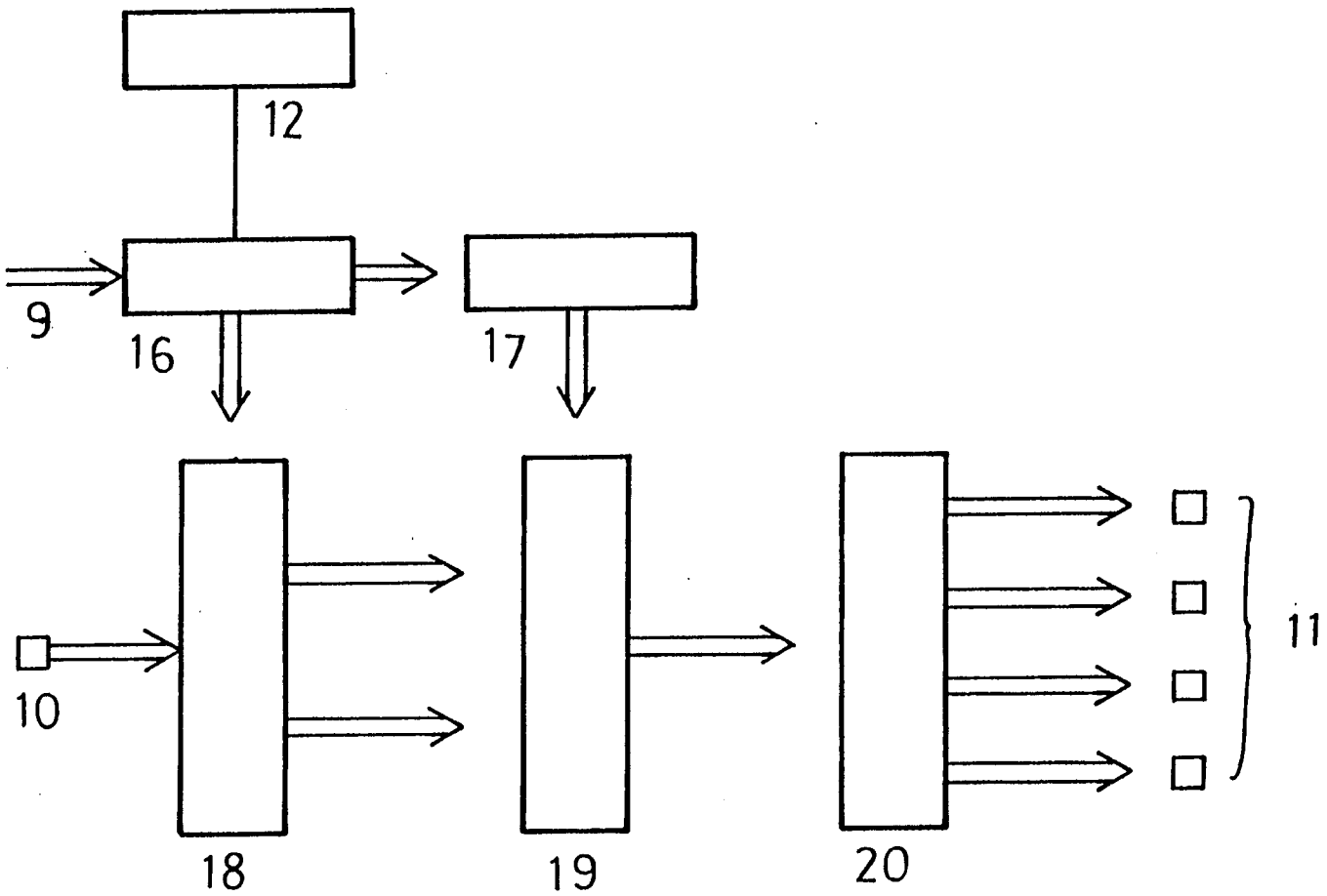
FIG. 2 (prior art)
FIG. 2 is a block diagram of the integrated circuit used in a Christmas light controller circuit of the prior art; and, FIG. 3 is a block diagram of one embodiment of the present invention.

The operation of the prior art Christmas light controller makes use of its own internal circuit to perform control functions, referring to FIG. 2. The integrated circuit alters its internal codes in accordance with the selector switch's selection action to control the driver 8 so that light sets attached to the driver produce assorted light variations. The integrated circuitry contains an oscillatory circuit 16, a time sequence generator 17, a stage control circuit 18, an internal code varying circuit 19, and an output control circuit 20.

Figure 3:
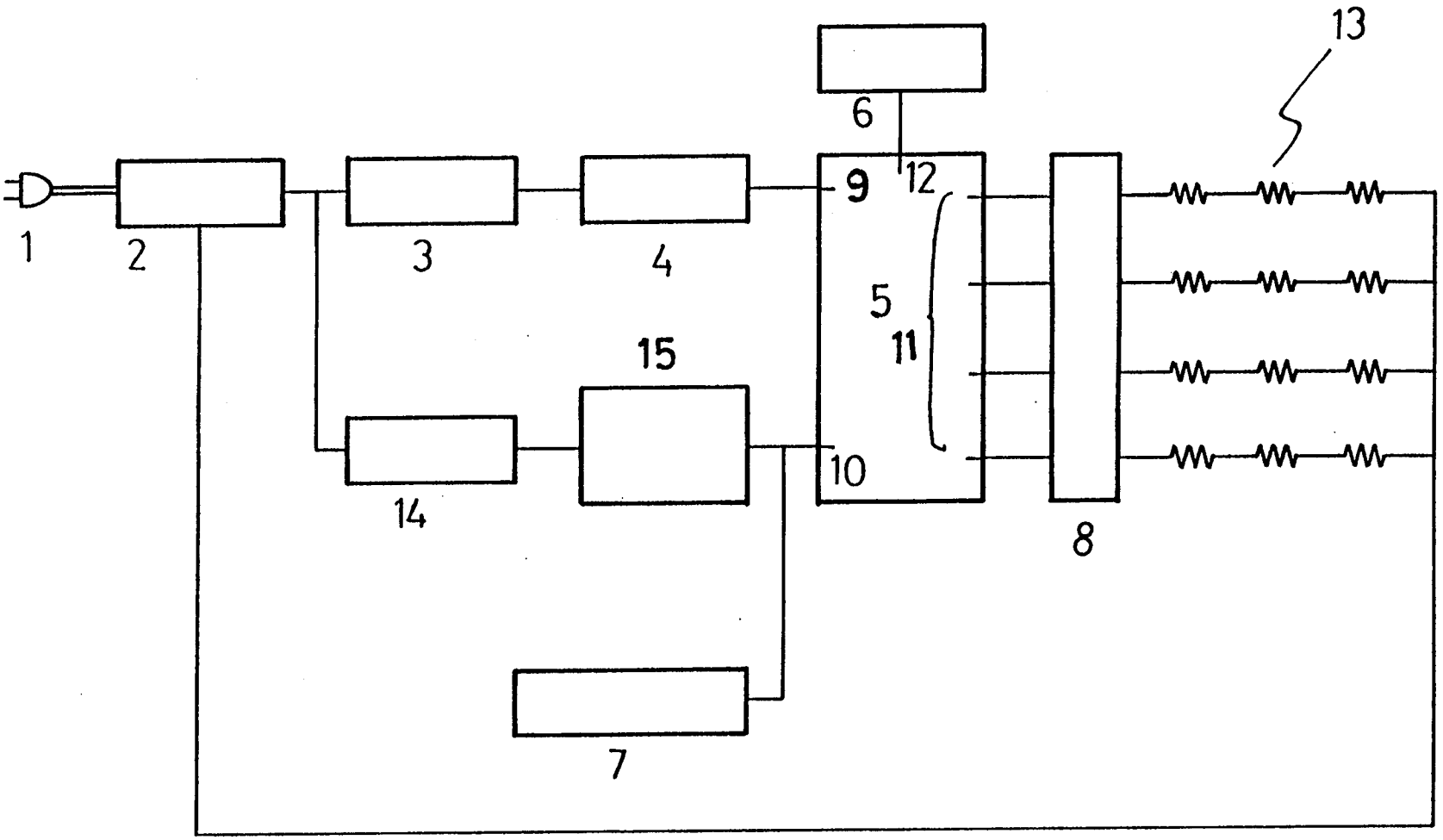

FIG. 3 indicates the constituents of an embodiment of the instant invention, in which the rectifier 2, the current-limiter 3, the voltage regulator 4, the oscillator 6, the integrated circuit controller 5, the driver 8, and the light sets 13 are located in the same order as that of the prior art controller circuits. However, between the output end of the rectifier 2 and the input of the current-limiter 3, there is provided a branch that connects the output of a rectifier 2 to a series combination of separator 14 and a power stage generator 15. Both the output of generator 15 and selector switch 7 are connected to the trigger pin 10 of the circuit controller 5.

The principle employed in the invention is that the controller circuit can automatically cyclically issue a sequential code from its internal code varying circuit as it receives a negative or positive potential drop (called negative or positive trigger voltage) and thus controlling the light variation, just like a power stage change.

With this arrangement, the apparatus of the invention operates as follows.

(i) As the power is turned on, the rectified current passing through the current-limiter 3 and the separator 14, causes the voltage regulator 4, and the power stage generator 15 to become charged, thereby powering the integrated circuit. If the integrated circuit is designed to respond to a negative voltage trigger, the charging in the power stage generator will not lead to stage selection triggering and so the integrated circuit remains in the power-on reset or initial state.

(ii) As the power is turned off and then turned on immediately (usually within ten seconds), the power stage generator 15 develops a negative potential, due to its discharge, concurrent with the turning off of power. Since the voltage regulator 4 maintains the normal operation of the integrated circuit during the outage, due to its slower rate of discharge, a voltage for the power-on reset state is not produced when electricity is restored. Therefore, the negative change in potential in the power stage generator 15, due to discharging thereof causes the stage selection circuit 18 of the integrated circuit to perform the stage selection function. If the outage is prolonged (usually greater than 60 seconds), the integrated circuit will be reset as the power is recovered.

(iii) As the power is turned off and then turned on immediately, the integrated circuit is maintained in a normal operation state, due to the slow discharging of the voltage regulator 4; however, the recharging of the power stage generator 15 cannot effect a negative voltage triggering, i.e., a stage selection triggering, and so the integrated circuit remains in that next sequential state to the state that existed before the power is turned off. As electricity is restored, the integrated circuit will have advanced into the next state.

(iv) If the integrated circuit is designed to respond to a positive voltage trigger, then when the power is turned on, the power stage generator will effect a stage selection triggering but a power-off action will not lead to a power stage selection. And so no matter which it is, a positive or a negative voltage trigger, a consecutive power-on and power-off action will effect the power stage selection of the circuit.

The separator 14 of the invention provides the function of eliminating interference between the voltage regulator 4 and the power stage generator 15 during charging and discharging thereof. Further, the separator circuit and the power stage generator circuit can also be incorporated into the integrated circuit so that users can make use of a consecutive power-on and power-off shift of the power source switch to control the stage selection of a Christmas light.

What is claimed is:

1. A staged selection type Christmas light controller circuit, comprising:

an integrated circuit controller having at least a power input pin, a trigger signal input pin, and a plurality of output pins, said integrated controller selectively changing which of said plurality of output pins are energized responsive to a trigger signal coupled to said trigger signal input pin;

power supply means coupled to said integrated circuit for supplying regulated DC voltage thereto, said power supply means including (1) a rectifier circuit having an input coupled to an AC source, (2) a current-limiter having an input coupled to an output of said rectifier circuit, and (3) a voltage regulator circuit having an input coupled to an output of said current-limiter and an output coupled to said input pin of said integrated circuit controller;

trigger signal generating means coupled between said power supply means and said trigger signal input pin for generating said trigger signal responsive to said rectifier circuit being disconnected from said AC source followed by reconnection thereto within a predetermined time period; and, a driver circuit having a plurality of inputs respectively coupled to said plurality of output pins of said integrated circuit controller, said driver circuit having a plurality of output terminals, each of said plurality of output terminals of said driver circuit being coupled to one end of a respective string of Christmas lights, each said string of Christmas lights having an opposing end coupled to said power supply means.

2. The staged selection type Christmas light controller circuit as recited in claim 1 where said trigger signal generation means includes a separator circuit coupled in series relation with a power stage generator between said power supply means and said trigger signal input pin of said integrated circuit controller.

3. The staged selection type Christmas light controller circuit as recited in claim 2 where said trigger signal generation means further includes a selector switch coupled to said trigger signal input pin of said integrated circuit controller.

4. The staged selection type Christmas light controller circuit as recited in claim 2 where said separator circuit has an input coupled to said output of said rectifier circuit.

* * * * *